United States Patent [19]

Pastva

[11] Patent Number: 4,877,276

[45] Date of Patent: Oct. 31, 1989

[54] DOOR CONTROL MECHANISM

[75] Inventor: John V. Pastva, Parma Heights, Ohio

[73] Assignee: The Eastern Company, Cleveland, Ohio

[21] Appl. No.: 56,345

[22] Filed: May 27, 1987

Related U.S. Application Data

[63] Continuation of Ser. No. 804,885, Dec. 5, 1985, abandoned.

[51] Int. Cl.[4] ..... E05C 9/08

[52] U.S. Cl. ..... 292/218; 292/11; 292/341.17

[58] Field of Search ..... 292/11, 104, 205, 218, 292/341.17

[56] References Cited

U.S. PATENT DOCUMENTS

| | | | |
|---|---|---|---|
| 1,009,001 | 11/1911 | Weber | 292/104 X |
| 1,277,754 | 9/1918 | Reed | 292/108 |
| 1,452,211 | 4/1923 | Myers | 292/205 |
| 1,812,334 | 6/1931 | Gloekler | 292/205 |
| 2,038,876 | 4/1936 | Sonabend | 292/218 |
| 3,572,794 | 3/1971 | Pastva | 292/218 |
| 3,737,183 | 6/1973 | Pastva, Jr. | 292/218 X |
| 3,917,328 | 11/1975 | De Filippi | 292/218 |
| 3,989,288 | 11/1976 | Schuller | 292/218 X |
| 4,114,935 | 9/1978 | Malo | 292/218 |
| 4,581,907 | 4/1986 | Eberly | 292/205 X |

*Primary Examiner*—Richard E. Moore

*Attorney, Agent, or Firm*—Watts, Hoffmann, Fisher & Heinke

[57] ABSTRACT

A door control mechanism including a shaft with a vertical axis of rotation, bearing members adjacent to opposite ends of the shaft which rotatably connect the shaft to a swinging door and a means for rotating said shaft along its longitudinal axis. Latch members are secured to the shaft at opposite ends and keeper members are secured to structure adjacent to opposite edge portions of the door which extend transverse to the pivotal axis of the door. A discrete security locking means connected to the shaft intermediate the means for rotating said shaft about its longitudinal axis and an upper end of the shaft is also included.

9 Claims, 3 Drawing Sheets

DOOR CONTROL MECHANISM

This is a continuation of co-pending application Ser. No. 06/804,885 filed on Dec. 5, 1985, now abandoned.

TECHNICAL FIELD

The present invention relates to a door control mechanism of the type used for securing and maintaining pivoted doors, and in particular to a security locking device for pivoted doors of trucks, trailers and/or large cargo containers, in their associated door frames, and the like.

BACKGROUND ART

Truck and trailer bodies and large shipping containers typically utilize pivoted double doors at one end wall to facilitate loading and unloading of the container compartment. Various door control mechanisms are used with such doors to retain the doors in a closed position and/or to reduce or eliminate racking. In the past, these mechanisms have included one or more shafts or lock rods which extend the height of the door and have latch members at each end which are engageable with keeper members on the door frame. They also have included a handle for rotating the lock rods, and handle-retaining elements attached to an associated door typically adapted to receive a padlock shackle or cable seal to lock the door in the closed position.

One mechanism of that type is illustrated in U.S. Pat. No. 3,737,183. The latch members include portions extending laterally from opposite sides of the lock rod and provided with cam surfaces engageable with surfaces of the keeper member.

One problem has arisen when these types of mechanisms are used on truck containers of the type carried piggy-back style on flat railroad cars. As the trains slow their speeds to travel through towns, thieves are able to steal the contents of the truck containers by climbing onto the cars and breaking or cutting the lock on the handle retaining elements. Since it is not uncommon that only the right hand door is locked, thieves are also able to break into truck containers by forcing the left hand door past the weather stripping which typically overlaps the left hand door.

DISCLOSURE OF INVENTION

The present invention provides a new and improved door control mechanism that includes a security locking assembly for locking single or double swinging truck, trailer or container doors.

According to the invention, the mechanism includes a shaft with a vertical axis of rotation rotatably connected to a swinging door by bearing members. The shaft has a handle for oscillating the shaft about its longitudinal axis and latch members secured to opposite ends of the shaft. Keeper members are secured to structure adjacent opposite edge portions of the door for engagement with the latch members.

A principal feature of the invention is a novel and improved door control mechanism that includes a security locking device positioned intermediate the shaft-rotating handle and an upper end of the shaft. The security locking device is positioned substantially above the handle to make the device difficult to reach by a person standing at the support level of the trailer or container. With the security device located high on the door, the process of breaking into the truck, trailer or container is more difficult and time consuming. It is believed the difficulty and delay will prevent or deter thieves from stealing the contents of the trailer or container.

In a preferred embodiment, a security latch member is pivotably secured to the shaft along a body portion and is rotatable about an axis substantially parallel with the shaft. A keeper member is adapted to be secured to structure adjacent an edge portion of the swinging door, and is engageable by the latch member to retain the door closed. The security locking device includes a movable member for selectively engaging and blocking movement of the latch member to prevent rotation of the shaft and disengagement from its keeper member.

In the preferred embodiment, the member that blocks the latch is pivoted and has two portions extending in substantially different directions. A first portion includes a surface that abuts the latch member and blocks its movement. A second portion includes an aperture for receiving a padlock shackle or cable seal for receiving a padlock shackle or cable seal against rotation. To this end, the security latch member includes a stationary portion located adjacent the second portion of the pivoted blocking member when the first portion is engaged with the latch member. The stationary portion includes an aperture for receiving a common shackle or cable with the pivoted part. The first and second portions each include a flange that limits access to the area adjacent the apertures and any received shackle or cable seal to inhibit cutting or other severing of the shackle or cable.

In a second embodiment, a bar extends from the shaft substantially above the handle and is locked against the door to prevent shaft rotation sufficient to unlatch the door. Preferably it consists of a second conventional lock-rod operating handle modified to provide limited lost motion in the direction of the shaft rotation.

The second handle is retained in a locked position by a handle retainer assembly that includes a bracket secured to the door and in which the handle rests, and a movable member pivotally mounted to the door. In the preferred embodiment, both the bracket and movable member include apertures alignable to receive a padlock shackle or cable seal to lock and prevent movement of the handle.

During a normal door-opening procedure, the lost motion connection allows the security handle to be moved out of the retaining bracket without rotation of the lock rod, before operating the door-opening handle, which is preventing any rod rotation. The conventional handle can then be used without interference from the security handle to unlatch and open the door.

These and other features and advantages of the invention will be better understood from the following description of the invention shown in the accompanying drawings.

BEST MODE FOR CARRYING OUT THE INVENTION

Figure 3:
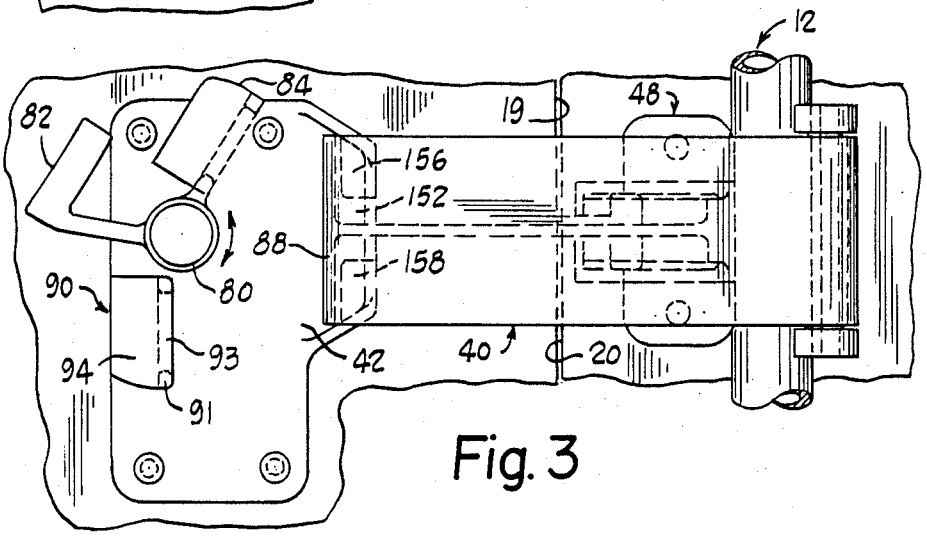
FIG. 3 is an enlarged view of a part of FIG. 1 illustrating a security latch in a condition to allow opening of the doors.
Figure 4:
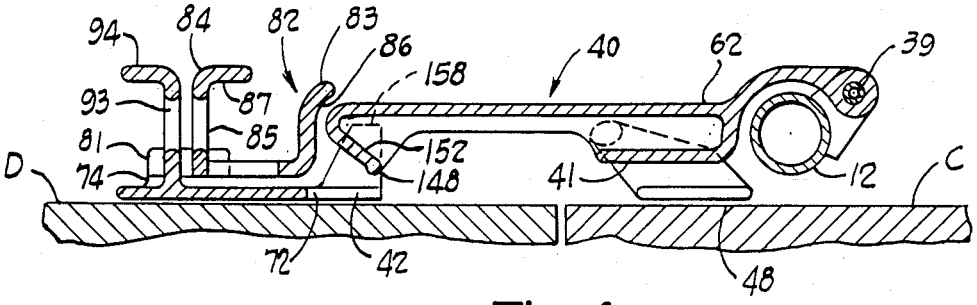
FIG. 4 is a view partly in section and partly in elevation taken along the line 4—4 of FIG. 2.
Figure 5:
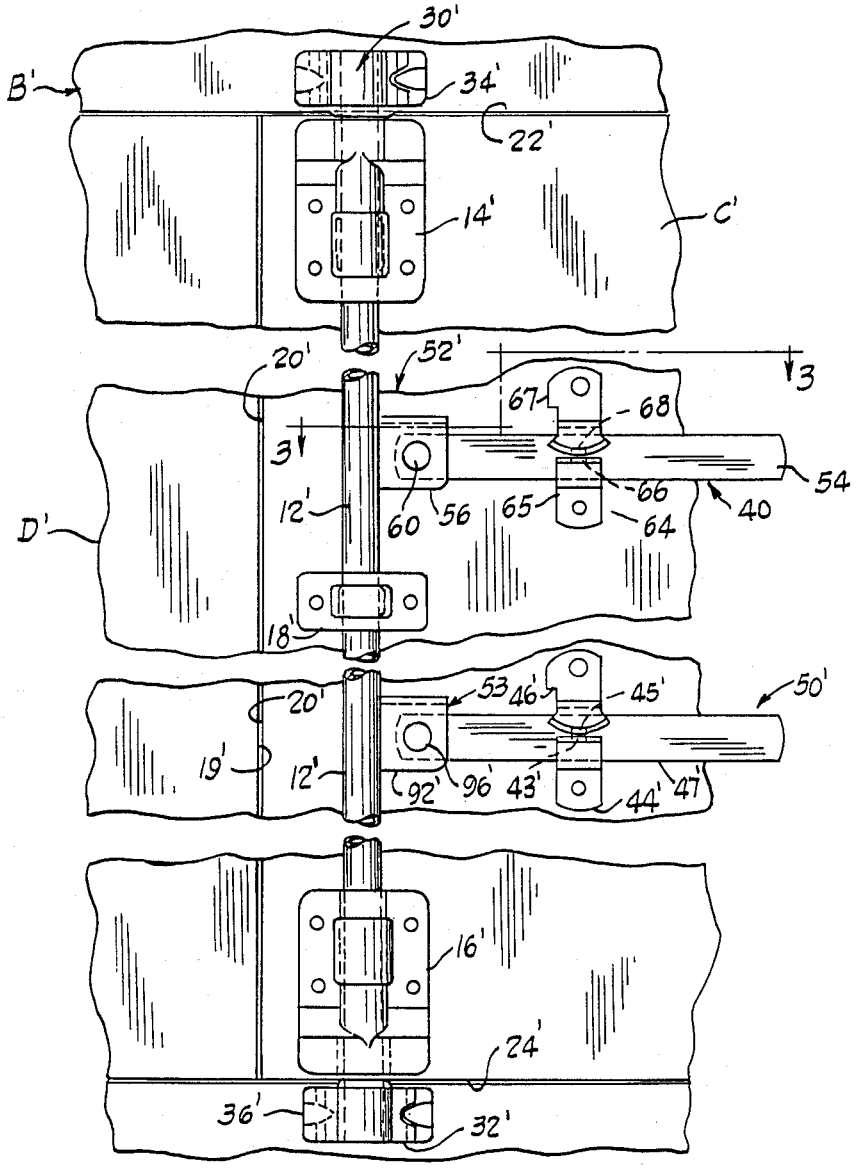
FIG. 5 is a partial elevational view of the back end of a truck, trailer or container having double access flush-type doors equipped with a second embodiment of the present invention.
Figure 6:
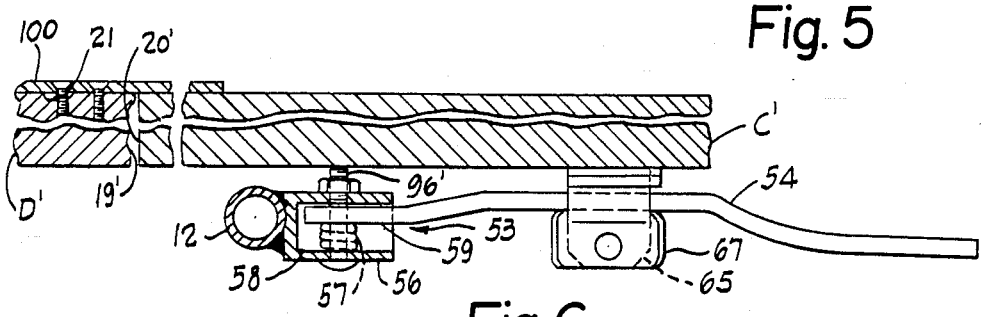
FIG. 6 is a view partly in section and partly in elevation taken along the line 6—6 of FIG. 5.

Two embodiments of door control mechanisms embodying the present invention for securing double access flush-type doors of a truck body, trailer or container are shown in FIGS. 1–4 and in FIGS. 5 and 6, respectively. Parts described in connection with the second embodiment that are identical to those of the first have been identified with the same reference numeral, but with a prime designation, and will not be separately described except to the extent required for clarity.

With reference to FIGS. 1–4, the first embodiment of a door control mechanism, shown securing the doors C, D of a piggyback trailer B, includes a shaft or lock rod 12 rotatably supported against axial movement by a plurality of upper and lower bearing members 14, 16, secured to the door C adjacent upper and lower edges 22, 24. An intermediate bearing member 18 is also provided along the outer side of the door C adjacent to its free non-pivoted side edge 20. The shaft 12 rotates on a vertical axis which is spaced from and parallel with the pivotal axis of the door C. A handle mechanism 50 is attached to the shaft at a location convenient for operation to rotate the shaft 12 about its longitudinal axis. Thus, this handle is located at a level above the support surface for the piggyback trailer that can be reached by a person standing on the support surface—e.g., standing on the flat bed of a train car typically about 5 feet above the surface.

Discrete upper and lower latch members 30, 32 are secured to opposite upper and lower ends of the shaft 12, as shown and described in U.S. Pat. No. 3,737,183, the disclosure of which is hereby incorporated herein by reference. The latch members 30, 32 are operated by rotation of the shaft 12 and cooperate with associated upper and lower keeper members 34, 36, which are secured to structure above and below upper and lower edge portions of the door C to properly align and close the swinging door C.

The handle mechanism 50 for rotating the shaft 12 about its longitudinal axis includes an elongated metal handle member 47 pivoted about a bolt 96 at one end in a channel-shaped receiver or so-called "handle clip" 92 welded to the shaft 12. The channel shape allows limited upward pivoting of the handle member 47 and allows the handle to pivot downward to a position along the shaft.

A handle retainer or keeper assembly attached to the door C secures the handle member 47 in a fixed position relative to the door. It includes a so-called seal plate and seal pin; i.e., a lower bracket member 44 fixed to the door to receive and support the handle against downward pivoting and to restrain movement away from the door, and a movable member 46 pivotally mounted to the door above the handle,.movable between the position shown in FIG. 1 that captures the handle and a raised position that allows the handle to be pivoted upward enough to clear the lower bracket member 44, and be pivoted away from the door, rotating the shaft to operate the latch members. Apertures 43, 45 are provided in the fixed bracket and the pivotable member for receiving a padlock shackle or cable seal to prevent use of the handle 47.

While not shown, a duplicate but mirror image assembly to that described is provided on the door D, but often the operating handle is not locked because the door C must be first opened to release the other door.

Because the handle mechanism 50 is readily accessible to facilitate operation of the door, the handle lock or seal can be easily tampered with. For that reason the door control mechanism of the present invention includes a security locking mechanism 52 attached to the shaft 12 to additionally prevent rotation of the shaft. The security mechanism is located between the handle mechanism 50 and the upper latch member 30, ideally at a height above the support surface of the truck trailer or piggy-back container where it can just be reached by a person standing on the support surface, or at a height that is just out of reach, making it difficult to tamper with.

The security lock mechanism 52 includes a latch member 40 pivoted to and operable by the shaft 12, a keeper 42 secured on the adjacent door D or on a door frame if used with a single door, a guide member 48 on the door C intermediate the shaft 12 and keeper 42 to control movement of the latch member, a blocking or retaining member 80 pivotably secured on the keeper member, and a stationary portion 90 of the keeper for preventing movement of the member 80.

The latch member 40 is a rectangularly shaped strap or plate-like member, the right hand end of which (in the orientation of FIGS. 1–4) overlies and is pivotally connected to the shaft 12. The opposite or left-hand end 88 of the member 40 has an inturned or reversed bend portion 148 which projects inwardly toward the shaft, and has a cam surface 152 that hooks over and engages spaced projections 156, 158 that extend from the keeper member 42.

As shown in FIG. 4, the latch member 40 extends transversely from the shaft, and includes a body portion 62 that is pivotably secured to the shaft 12 about a pin 39 the axis of which is substantially parallel with but offset from the axis of the shaft 12.

The guide member 48 is positioned on the door C so that as the member 40 is moved by rotation of the shaft 12, its pivotal movement is limited by the cooperation of guide projections 48*a*, 48*b* with the body portion 62 and a longitudinal flange 41 parallel thereto. The arrangement allows back and forth movement of the latch member across the doors but restrains movement toward and away from the doors at the location of the guide projections, so the latch member will properly latch onto and unlatch from the keeper member through shaft rotation.

The keeper 42 includes a base portion 72 attached to the face of door D or other structure located adjacent the free edge 20 of door C. The base portion 72 of the keeper further includes a boss 74 extending from the base portion perpendicularly to the door and supporting the pivotal blocking member 80.

The blocking member has a hub 81, received by the boss 74, and first and second arms 82, 84 extending generally radially in different directions from the hub 81. The first arm 82 terminates at a distal end in an abutment surface 86 that, in one position of the member 80, is directly opposed to the free end 88 of the security latch member 40 and prevents its movement across the door and hence prevents rotation of the shaft 12. In a preferred structure, the surface 86 is elongated parallel to the free end 88 and extends generally perpendicular to the base 72, but has a slightly curved portion 83 that partially overlaps the free end 88.

The second arm 84, in the preferred embodiment, extends from the hub 81 substantially parallel to the surface 86 and displaced about 90 angular degrees about the hub. The second arm 84 includes a portion 89 extending perpendicular to the base 72, and a flange 87 along that portion of the arm, spaced from and parallel to the base 72. An aperture 85 is in the arm 84 behind the flange to receive a padlock shackle 28 or seal cable. The flange 87 extends a distance from the arm portion 89 toward the abutment surface 86 sufficient to shield the shackle or cable from being easily cut or impacted.

Figure 1:
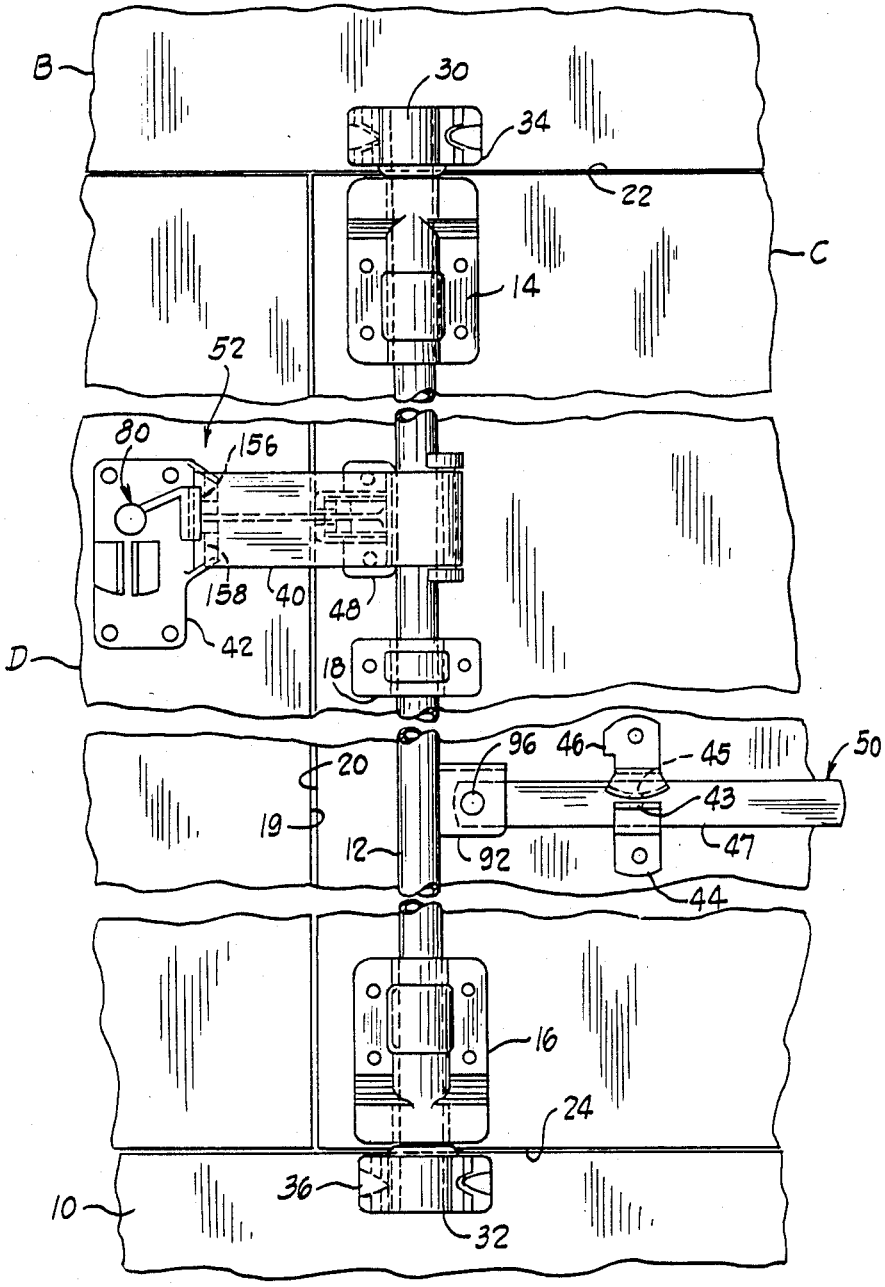
FIG. 1 is a partial elevational view of the back end of a truck, trailer or container having double access flush-type doors equipped with one embodiment of the present invention.
Figure 2:
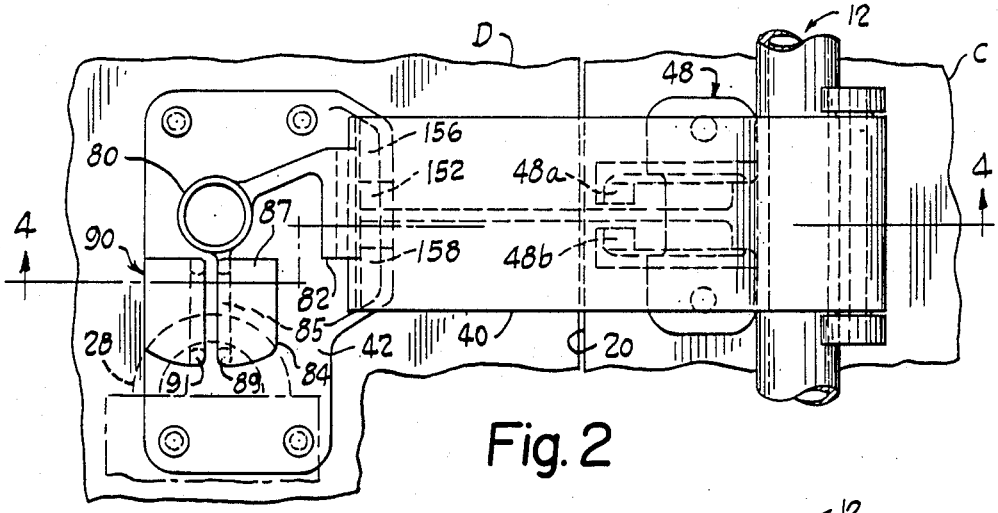
FIG. 2 is an enlarged view of a part of FIG. 1 illustrating the security latch in a condition preventing opening of the doors.

The stationary projection 90 includes a portion 91 extending perpendicularly from the base 72 and parallel to the second arm 84 when the first arm is in blocking position as illustrated in FIG. 2. The projection 90 also includes a flange portion 94 in the plane of the flange 87, but extending opposite in direction when the second arm is adjacent the stationary projection 90. An aperture 93 is in the portion 91 behind the flange 94 and is aligned with the aperture 85 to receive a common shackle or cable. The flange extends a distance equal to the first flange 87 and serves the same purpose, the two together providing an effective protective shield for the lock or seal when a lock or seal extends through both apertures 85, 93. The stationary projection 90, together with a lock or cable, prevents rotation of the blocking member 80.

To unlatch the security lock assembly 52, the pivotable blocking member 80 is rotated in a counter clockwise direction from the position shown in FIG. 2 to that of FIG. 3. When the portions 82, 84 are rotated to positions that do not interfere with the latch member 40, the latch member may be moved out of engagement with the keeper 42, to an unlatched position. It will be appreciated that, with the keeper 42 located on the door D, the security lock mechanism 52 prevents either door from being opened.

Referring to FIGS. 5 and 6, an alternate embodiment of the invention is shown. It is identical in all respects to the embodiment of FIGS. 1–4 except that a different security locking mechanism 52' is provided in the form of a modified operating handle 54 secured to the shaft 12' above the conventional handle 50', in the location of the mechanism 52 of the previous embodiment and for the same purpose. The mechanism 52' includes a locking arm 54 that functions as a latch member, a retaining mechanism 64, including a lower bracket 65 and a movable member 67, an interconnection 53 having lost motion in the direction of rotation of the shaft 12' and a plate 100 secured to an interior surface 21 of the piggyback trailer door D' and overlapping the door edges 19', 20' for preventing opening of the door D' without first opening the door C'.

The locking arm 54 is secured to and extends transversely to the shaft. In the illustrated embodiment, the arm is pivoted about a bolt 60 at one end in a channel shaped receiver or "handle clip" 56 welded to the shaft 12' for permitting rotation of the arm 54 about an axis transverse to the shaft. While the interconnection of the locking arm 54 is substantially similar to the handle mechanism 50' connection, it differs in that the receiver 56 has a wider channel-shape in a direction transverse to the door C, providing for lost motion between the handle and the shaft when the handle is used to rotate the shaft.

The lost motion connection 53 also includes a spring 57 that is positioned between a wall of the bracket 58 and a surface of the locking arm 59. By pivoting the locking arm first upward and then away from the door C', the spring 57 is compressed between the bracket 58 and arm surface 59. As the spring is further compressed, the arm 54 eventually clears the lower bracket 65 of the retaining mechanism 64 without rotation of the shaft 12'.

The locking arm 54 is retained in a locked position by the retaining mechanism 64 mounted on door C'. The retaining mechanism 64 includes elements identical to bracket 44' and member 46'; specifically, the lower bracket 65 which is fixed to door C', and the movable member 67 pivotally mounted to the door above the bracket 65. Apertures 66, 68 are provided in the fixed bracket and movable member, similar to apertures 43' and 45', for receiving a padlock shackle or cable seal used to lock the locking arm 54 in the latched position.

The plate 100 is attached to the interior of door D' by threaded fasteners. The plate extends along the surface 21 and overlaps the adjacent door edges 19', 20' to prevent the door D' from being forced open without first opening door C'.

With this embodiment, the security latch must be unlocked and also separately released. This can be done because of the lost motion connection of the handle 54 to the shaft 12'. Thus, to open the door C' the locking arm 54 is unlatched from the latched position by rotating the member 67 and pivoting the handle upward out of the bracket member 65 and then pivoting the handle about the axis of the shaft 12' away from the door C', utilizing the lost motion connection until the handle clears the bracket 65, and then allowing the handle to pivot downward along the shaft 12', where it will no longer interfere with the door opening process, which may then be performed by the handle 47 in the normal manner.

From the above it will be apparent that a novel and improved door control mechanism has been provided, in which a security locking mechanism functions intermediate an upper end of the shaft and the handle mechanism used for rotating the shaft. While preferred embodiments of this invention have been described in detail, it will be apparent that certain modifications or alterations can be made therein without departing from the spirit or scope of the invention set forth in the appended claims.

I claim:

1. A door control mechanism for securing a swinging door in a closed position, said mechanism comprising a shaft having a vertical axis of rotation, bearing members adjacent to opposite ends of said shaft adapted to rotatably connect said shaft to a swinging door with the shaft axis of rotation spaced from and parallel with the pivotal axis of the door, door operating means attached to the shaft for oscillating said shaft about its longitudinal axis, discrete latch members secured to said shaft adjacent to opposite ends thereof, discrete keeper members adapted to be secured to structure adjacent to opposite edge portions of a door that extends transversely to the pivotal axis of the door, said keeper members being engagable with said latch members, and a discrete security locking means connected to said shaft intermediate the means for oscillating said shaft about its longitudinal axis and an upper end of said shaft, said locking means including a security latch member pivotably secured to said shaft for lateral movement between latched and unlatched positions upon movement with said shaft and means for engaging said pivoted latch having a first base part secured to a structure adjacent a door and a second part movably secured to the first part to engage an end of the latch member to block lateral movement of the latch member and thereby prevent rotation of said shaft by said door operating means.

2. The door control mechanism of claim 1 wherein the means for engaging said pivoted latch member to prevent rotation of said shaft includes means to receive a padlock shackle or cable seal securable to structure adjacent a swinging door to which said shaft is securable and movable with said second part of said engaging means and including a shield portion spaced from and parallel with said adjacent structure, and extending to cover said receiving means and to limit access adjacent the security latch to the shackle or cable seal received by said receiving means.

3. The door control mechanism of claim 1 wherein the security locking means comprises a security latch member having a body portion secured to said pivotable shaft about an axis substantially parallel with said shaft, a keeper member adapted to be secured to structure adjacent an edge portion of a swinging door, a movable locking member adjacent the keeper member for selectively blocking movement of the security latch member, and means for limiting movement of said locking member.

4. The door control mechanism of claim 3 wherein the security locking means includes a guide member for engagement with the latch member and securable to the same swinging door and adapted to be positioned between said latch member body portion and the same swinging door for limiting pivotal movement of said latch member.

5. The door control mechanism of claim 3 wherein the locking member includes a pivoted part having first and second portions extending in substantially different directions, said first portion providing a surface for abutment with said latch member, said second portion providing an aperture to facilitate locking said pivoted part against rotation and said limiting means includes a stationary part adjacent said second portion when the first portion abuts the latch member and also having an aperture to facilitate locking said pivoted part.

6. The door control mechanism of claim 5 wherein each said second portion of said pivoted part and said limiting means includes a flange for limiting access to a member extending through said apertures.

7. A door control mechanism of claim 1 wherein the security locking means comprises a latch member connected to said shaft for pivotal movement at one end about an axis substantially parallel with but offset from the axis of said shaft, said latch member having a body portion, a keeper member having a base portion adapted to be secured to structure adjacent the edge of the door and a portion for engagement by said latch member, said base portion supporting the locking means thereon the means comprising a pivotable member for selectively obstructing the latch member from being unlatched upon rotation of the shaft, said pivotable member having an abutment portion for blocking movement of the latch member to an unlatched position, and a portion for positioning the member between an obstructing position and a non-obstructing position, said base portion having means for preventing the pivotable member from pivoting.

8. A door control mechanism of claim 7 wherein said second portion and said limiting means for preventing pivoting of the pivotable member each include an aperture alignable for receiving the padlock shackle or cable seal.

9. A door control mechanism for securing a swinging door in a closed position, said mechanism comprising a shaft having a vertical axis of rotation, bearing members adjacent to opposite ends of said shaft adapted to rotatably connect said shaft to a swinging door with the shaft axis of rotation spaced from and parallel with the pivotal axis of the door, door operating means attached to the shaft for oscillating said shaft about its longitudinal axis, discrete latch members secured to said shaft adjacent to opposite ends thereof, discrete keeper members adapted to be secured to structure adjacent to opposite edge portions of a door that extends transversely to the pivotal axis of the door, said keeper members being engagable with said latch members, and a discrete security locking means connected to said shaft intermediate the means for oscillating said shaft about its longitudinal axis and an upper end of said shaft, said locking means including a security latch member pivotably secured to said shaft for lateral movement between a latched position in which the pivoted latch member is parallel with the door and an unlatched position upon movement with rotation of said shaft and means for engaging said pivoted security latch member including a first part securable to a structure adjacent an edge of such a swinging door parallel with said shaft and a second part movable about an axis transverse to the plane of the door when closed, to engage an end of the latch member spaced from the shaft to block lateral movement of the latch member and thereby prevent rotation of said shaft by said door operating means, and including means to receive a padlock shackle or cable seal to prevent movement of said engaging means, said receiving means being securable to said structure and movable with said second part of said engaging means and including a shield portion spaced from and parallel with the plane of such a door when closed, extending to cover said receiving means and to limit access adjacent the security latch member to the shackle or cable seal received by said receiving means.

* * * * *